US005836521A

United States Patent [19]

Holm et al.

[11] Patent Number: 5,836,521

[45] Date of Patent: Nov. 17, 1998

[54] VALVE DEVICE WITH IMPACT MEMBER AND SOLENOID FOR ATOMIZING A LIQUID

[75] Inventors: Karl Holm, Brovst; Knut Meyer, Rungsted Kyst, both of Denmark

[73] Assignee: Dysekompagniet I/S, Virum, Denmark

[21] Appl. No.: 898,901

[22] Filed: Jul. 23, 1997

Related U.S. Application Data

[63] Continuation of Ser. No. 341,561, Mar. 9, 1995, abandoned.

[51] Int. Cl.[6] ..... B05B 1/30

[52] U.S. Cl. ..... 239/584; 251/129.16; 251/129.21

[58] Field of Search ..... 239/4, 5, 102.2, 239/338, 569, 584–585.5; 251/129.21, 129.2, 129.16, 129.15, 129.08, 129.05, 129.02, 129.01

[56] References Cited

U.S. PATENT DOCUMENTS

| | | | |
|---|---|---|---|
| 3,450,353 | 6/1969 | Eckert . | |
| 3,702,683 | 11/1972 | Sturmer . | |
| 3,977,607 | 8/1976 | Kobayashi et al. . | |
| 4,027,850 | 6/1977 | Allen . | |
| 4,373,671 | 2/1983 | Giardini | 239/585.5 |
| 4,440,132 | 4/1984 | Terada et al. . | |
| 4,449,691 | 5/1984 | Führer et al. . | |
| 4,759,335 | 7/1988 | Ragg et al. | 239/5 X |
| 4,798,188 | 1/1989 | Ito et al. . | |
| 4,867,128 | 9/1989 | Ragg et al. | 239/5 X |
| 4,888,205 | 12/1989 | Hartman . | |
| 5,037,062 | 8/1991 | Neuhaus . | |
| 5,193,745 | 3/1993 | Holm | 239/102.2 |
| 5,482,018 | 1/1996 | Potz et al. | 239/584 X |

FOREIGN PATENT DOCUMENTS

| | | |
|---|---|---|
| 0036617 | 9/1981 | European Pat. Off. . |
| 0131694 | 7/1986 | European Pat. Off. . |
| 0223018 | 4/1989 | European Pat. Off. . |
| 0324452 | 7/1989 | European Pat. Off. . |
| 0234642 | 4/1990 | European Pat. Off. . |
| 0258637 | 6/1990 | European Pat. Off. . |
| 0387179 | 9/1990 | European Pat. Off. . |
| 2062420 | 6/1972 | Germany . |
| 2541927 | 12/1979 | Germany . |
| 62-278385 A | 12/1987 | Japan . |
| 658 504 | 11/1986 | Switzerland . |
| 1 382 828 | 2/1975 | United Kingdom . |
| 2137420 | 10/1984 | United Kingdom . |
| 2177623 | 1/1987 | United Kingdom . |
| 86/06441 | 11/1986 | WIPO . |
| 90/03512 | 4/1990 | WIPO . |

*Primary Examiner*—Lesley D. Morris
*Attorney, Agent, or Firm*—Merchant, Gould, Smith, Edell, Welter & Schmidt

[57] ABSTRACT

A valve or nozzle device for atomizing a liquid into very small drops comprises a valve member (21) having an annular surface part (24) diverging in a direction downstream of the valve seat (32). The valve member is reciprocatingly moveable between open and closed positions. The valve member (21) is opened very rapidly by an impact member (38) driven by magnetic forces generated by a solenoid (41). The vibrating frequency is controlled by an electric control circuit so as to obtain the desired small droplets and the desired dosage. The atomizing nozzle may, for example, be used to atomize a liquid medicament or to atomize liquid fuel.

71 Claims, 3 Drawing Sheets

VALVE DEVICE WITH IMPACT MEMBER AND SOLENOID FOR ATOMIZING A LIQUID

Figure 1:
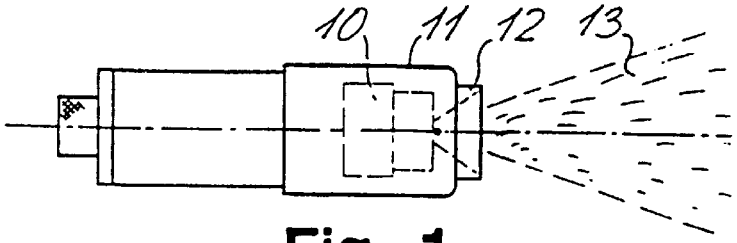

This is a Continuation of application Ser. No. 08/341,561, filed Mar. 9, 1995 now abandoned.

The present invention relates to a valve device for atomizing a liquid into small drops.

For many applications it is of great importance that a liquid may be discharged in the form of extremely small drops the substantial part of which is within rather narrow, predetermined size limits. As an example, a liquid medicament to he inhaled must be atomized into such small droplets in order to be effective, preferably without using freon or another gaseous propellant. Furthermore, a liquid fuel being injected into a combustion chamber or an intake of a combustion engine, a furnace or another combustion chamber, must also be atomized into small drops in order to secure a substantially complete combustion of the liquid fuel.

Liquid atomizing valves of the type in question are disclosed, for example in EP-A-0 036 617, EP-B-0 234 642, EP-B-0 223 018, WO 90/03512, and U.S. Pat. No. 4,798,188.

The present invention provides an improved liquid atomizing valve device by means of which a liquid may be atomized into very small drops or droplets, the main part of which having a size being within rather narrow limits.

Thus, the present invention provides a valve device for atomizing a liquid into small drops, said valve device comprising a housing defining an annular valve seat therein, a valve member having an annular surface part diverging in a direction downstream of the valve seat, the valve member being moveable in relation to the housing between an open position in which an annular nozzle opening is defined between the annular, diverging surface part and the valve seat, and a closed position in which the diverging surface part is in sealing engagement with the valve seat, means for moving the valve member between its open and closed positions, and control means for controlling the movement of the valve member, so as to obtain a desired small size of the drops and/or to dose the atomized liquid.

When the liquid to be atomized is fed to the nozzle opening of the device at a superatmospheric pressure, and a reciprocating or vibrating movement is imparted to the valve member and controlled by the control means so that the valve device is opened and closed at rather small time intervals, the small liquid volume being discharged through the nozzle opening each time the valve member is in its open position, is divided into a large number of small drops.

Preferably, the valve member is not being oscillated with a frequency corresponding to the natural frequency of the movably mounted valve member, but the movement of the valve member between its opened and closed position is effectively controlled by the control means so that the drop size and dosing desired is obtained.

It has been found, that the control means should preferably control the reciprocating movement of the valve member between its closed and open positions so that the valve member stroke is relatively long compared with the desired drop size. According to the present invention the minimum width of the annular nozzle opening defined between the diverging surface part of the valve member and the valve seat preferably substantially exceeds the average value of the desired diameter of the liquid drops generated (in number distribution), when the valve member is in its open position. Thus, the minimum width of the nozzle opening in the open position of the valve member may be 3–20 times and preferably 5–10 times the average value of the desired drop diameter.

The relatively large flow area of the nozzle opening reduces the loss in flow energy of the liquid due to frictional forces. Such loss in flow energy may be further reduced by defining the valve seat as a relatively sharp annular edge, for example, having an axial width being smaller than 0.2 mm, preferably smaller than 0.1 mm. Such sharp edge or narrow annular valve seat reduces the closure pressure necessary to obtain a tight seal. Consequently, the force or forces to be applied to the valve member by the moving means may also be reduced.

The liquid being discharged from the nozzle opening while the valve member is in its open position may tend to move as a liquid film along the diverging surface part, which may have a frustoconical shape. In order to prevent such liquid from passing around a free edge of such frustoconical surface part and form too large drops the valve member may further comprise a converging surface part extending downstream of the diverging surface part and preferably defining a pointed end at the free downstream end of the valve member. An annular, relatively sharp edge is preferably defined between the diverging surface part, which may be frustoconical, and a converging surface part, which may be a conical surface part.

The liquid discharged from the annular nozzle opening may tend to form a tubular liquid film.

It is desirable to choose a relatively large diameter of the valve seat in order to increase the diameter of the tubular liquid film and thereby counteract collapse of the same, because such collapse would cause the formation of undesired relatively big drops. On the other hand, however, it is also desirable to keep the mass of the reciprocating valve member as low as possible. As a compromise, the diameter of the valve seat may be 1–5 mm and preferably 2.5–3 mm.

The diameter of the annular edge defined between the diverging and converging surface parts must, of course, be greater than the diameter of the valve seat in order to obtain sealing engagement between the valve seat and the diverging surface part. According to the present invention the diameter of the annular edge defined between the diverging and the converging surface part may be 0.3–1 mm and preferably about 0.5 mm greater than the outer diameter of the annular nozzle opening.

The angle defined by the frustoconical diverging surface part should exceed a certain minimum value in order to avoid the tendency of wedging in the annular seat. The angle defined by the diverging surface part may be 26°–50°, preferably 32°–40°, for example about 36°. The converging surface part may be a conical surface part defining an angle of 60°–120°, preferably about 90°. The valve device according to the invention may further comprise liquid supply means for supplying the liquid to be atomized into the valve housing at a superatmospheric pressure, which may suitably be 200–700 Kpa, preferably 300–400 Kpa.

In principle, the valve member may be moved between its closed and open positions by any suitable mechanical and/or electrical moving means. In the preferred embodiment, however, the means for moving the valve member comprises electromagnetic means. It is important that the valve member is moved from its closed to its open position so quickly that the flow of liquid through the nozzle opening hardly starts until the valve member is in its fully opened position. In order to obtain such quick opening movement the moving means may further comprise a first impact member, which may be accelerated by the electromagnetic means and which may imply an impact load to the valve member, which is thereby opened rather suddenly. The valve member may then be retained in its open position in the desired period of time, for example under the influence of the electromagnetic means. If desired, the moving means may further comprise a second impact member which may be accelerated by the electromagnetic means and which may apply an impact load to the valve member so as to also obtain a quick movement of the valve member from its open to its closed position.

In the preferred embodiment, however, the valve member is biassed towards its closed position by spring means. That means that the valve member is returned to its closed position under the influence of the spring means when the electromagnetic bias towards the open position is terminated.

The liquid atomizing effect may be improved by reducing the time period in which the valve member is fully open, and by choosing high opening and closing speeds of the valve member. The high opening speed of the valve member may cause a rebound movement from the open position of the valve member, and such rebound movement may drastically increase the closing movement of the valve member without increasing the moving force applied to the valve member by the moving means.

Preferably, the moving means are adapted to move the valve member from its closed to its open position at an average speed exceeding 0.5 m/sec.

The desired atomization of the liquid may possibly be further improved by vibration means for applying ultrasonic vibrations to the liquid within and/or outside the valve housing. Such ultrasonic vibrations may, for example, be applied to a stem part of the valve member, the diverging surface part of the valve member, the converging surface part of the valve member, the valve seat and/or other housing parts defining a valve chamber inside the valve seat. The vibration means for providing the ultrasonic vibrations may be of any conventional type and may, for example, comprise piezo ceramics.

In order to obtain a tight seal between the valve seat and the diverging surface part of the valve member cooperating therewith, these cooperating parts may be highly smooth and may preferably have a Ra-value being less than 0.4 $\mu$m. Furthermore, it is important that the cooperating surfaces have a completely circular cross-sectional shape which means that the width of the annular nozzle opening (namely the minimum width of the passage defined between the valve seat and the diverging surface part of the valve member) should be extremely uniform along the peripheral extension of the nozzle opening.

In order to obtain the desired uniform width of the nozzle opening in the open position of the valve member, the valve member must be mounted so as to allow the valve member to move exactly along the axis of the valve seat. The stem of the valve member may be mounted in the housing in any suitable manner, for example by means of a slide bearing and/or by means of a membrane or diaphragm, and the valve member stem may define an abutment surface thereon for abutting engagement with a complementary surface defined in the valve housing, so as to determine the open position of the valve member, said surfaces being shaped so as to ensure alignment of the valve member in relation to the nozzle opening. The abutment surface and the complementary surface may, for example, be complementary conical or frustoconical surface parts.

In order to improve the uniformity of the liquid film formed on the diverging surface parts of the valve member in the open position of the valve device, the valve device may further comprise means arranged upstream of the valve seat for imparting to the liquid passing the valve seat a rotary movement around the axis of the valve seat and of the diverging annular surface part of the valve member. Such rotary movement imparting means may comprise at least one substantially linear liquid supply passage or channel having its axis directed substantially at right angles to and inwardly towards the longitudinal axis of the valve member, but being slightly transversely spaced therefrom.

The invention also relates to a method of controlling the operation of a valve device as that described above. Thus, according to the invention, the average size of the drops of the atomized liquid and/or dosing of the atomized liquid may be controlled by controlling the frequency, the number of movements or movement pulses, the stroke length, the opening periods, and/or the closing periods of the reciprocatingly moved valve member. As explained above the average drop size may be reduced by controlling the movement of the valve member so that the opening movement and preferably also the closing movement of the valve member is relatively quick. Furthermore, the average drop size is also influenced by the amplitude or stroke of the vibrating valve member movement, and as explained above, the amplitude should preferably be such that the minimum width of the nozzle opening is 3–20 times, and preferably 5–10 times the average value of the desired drop diameter. Because the amount of atomized liquid discharged through a nozzle in each opening period of the valve member is relatively constant it is possible to obtain a desired dose by operating the nozzle at a certain frequency for a certain period of time so as to obtain the necessary number of opening movements of the valve member in order to obtain the dose desired.

When the valve device is a fuel injection valve device, for example for the injection of fuel into the combustion chamber of a combustion engine, the operation of the valve device may advantageously be shifted from a starting mode in which clouds of relatively small droplets are generated into a running mode in which jets of bigger droplets are provided. When a combustion engine is cold and has to be started it is important that the fuel is atomized into clouds of droplets which are so small that the liquid easily evaporates. When the combustion engine has been operating for a certain period of time and has become warm, the valve device may be shifted into the running mode in which jets of bigger droplets are directed towards the warm inlet valve of the engine, whereby these bigger droplets are evaporated and the inlet valve is being cooled.

Figure 2:
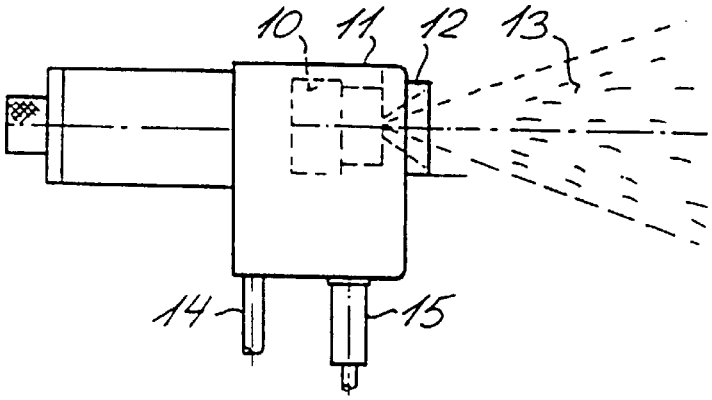
Figure 3:
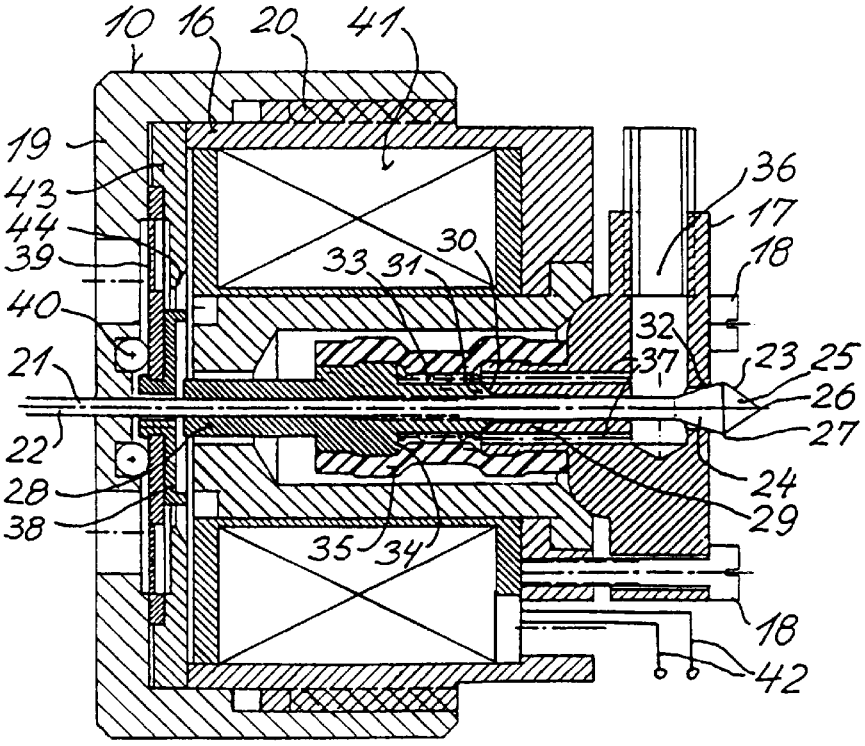
Figure 4:
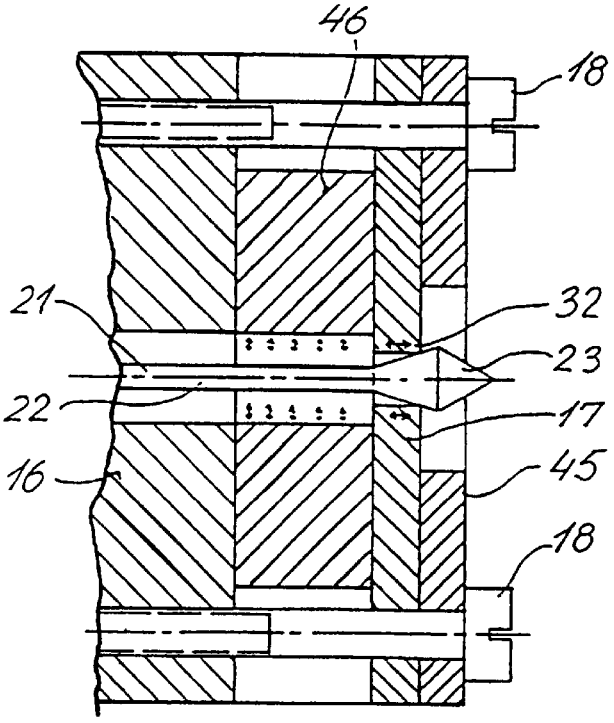
Figure 5:
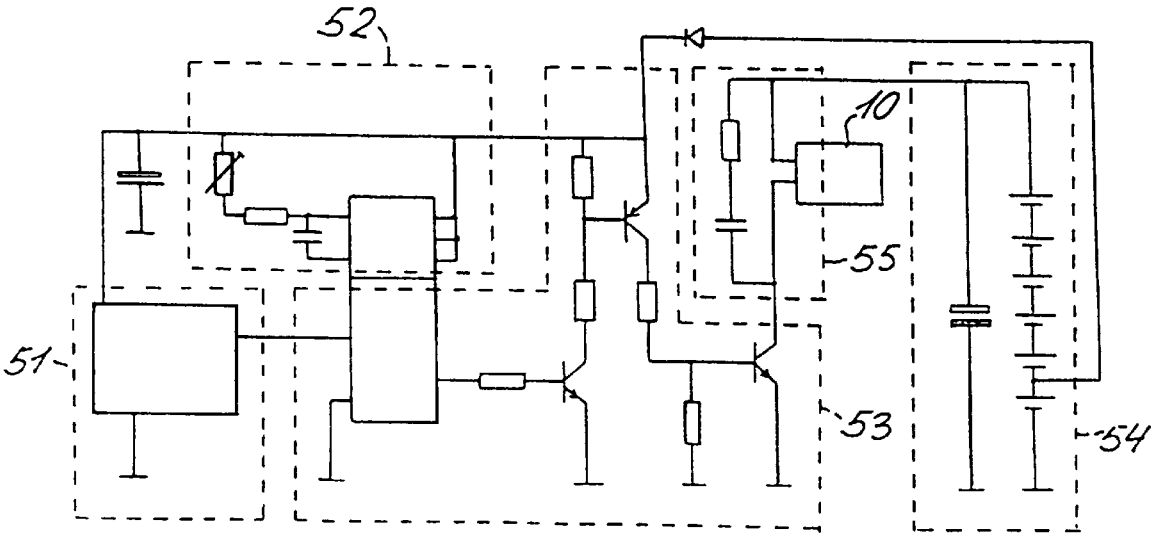
Figure 6:
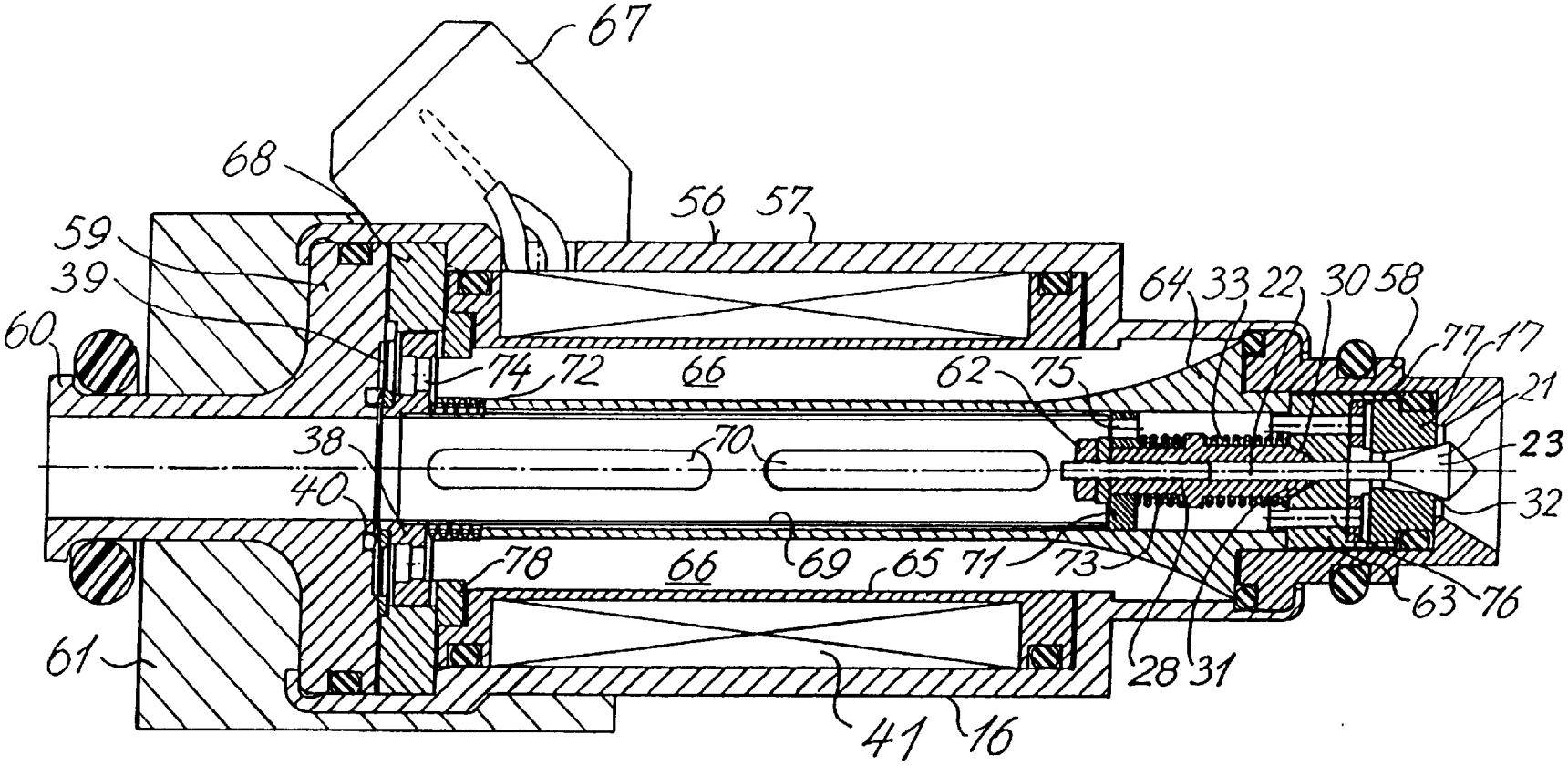

The invention will now be further described with reference to the drawings, wherein FIGS. 1 and 2 are a plan view and a side view, respectively, of a prototype inhalator embodying the nozzle according to the invention, FIG. 3 is a sectional view of a first embodiment of an atomizing nozzle or valve device according to the invention shown in an enlarged scale, FIG. 4 is part of a sectional view showing part of a modified embodiment of the nozzle, FIG. 5 is a diagram illustrating an electric control circuit for controlling the operation of the atomizing nozzle, and FIG. 6 is a longitudinal sectional view of a second embodiment of the valve device according to the invention.

The inhaler shown in FIGS. 1 and 2 comprises an atomizing nozzle device 10 which is arranged within an inhaler housing 11 with a spout 12 through which a spray 13 of an atomized liquid medicament may be discharged from the nozzle device 10. The inhaler is a hand-held device, and the housing may contain a pressurized liquid medicament source for supplying the nozzle device 10 with pressurized liquid medicament, and a battery or another electrical energy source for supplying electric driving power to the nozzle device. Alternatively, a supply conduit 14 may connect the nozzle device 10 within the housing 11 to an external source of pressurized air or gas for pressurizing a medicament reservoir arranged within the housing 11, and an electric power and control cable 15 may connect the nozzle device to an external electrical power supply and to a control device, not shown.

As shown in FIG. 3, the nozzle device 10 comprises a nozzle housing 16, which is closed at one end by a valve seat member 17 fastened to the housing 16 by means of screws 18. At the opposite end the housing is closed by means of a screw cap 19 having internal threads engaging with external threads 20 formed on the outer peripheral surface of the nozzle housing 16.

A valve member 21 comprising a stem part and an enlarged head 23 extends axially through the housing and through bores defined in the valve seat member 17 and in the screw cap 19, respectively. The valve member head 23 defines a frustoconical surface part 24 and a conical surface part 25 defining a pointed tip 26. A sharp annular edge 27 is defined between the surface parts 24 and 25. The stem part 22 is surrounded by an anvil sleeve 28 fastened to the stem part 22 by a screw connection and arranged within the housing 16. The stem part 22 extends through an inwardly directed tubular extension formed on the valve seat member 17, and a concave frustoconical abutment surface 30 formed at the inner end of the tubular extension 29 may cooperate with a complementary, convex frustoconical abutment surface 31 formed at the adjacent free end of the anvil sleeve 28. The frustoconical surface part 24 formed on the head 23 may engage with a sharp, edge-shaped valve seat 32 defined at the outer surface of the valve seat member 17. The frustoconical surface part 24 of the head 23 is biased towards the valve seat 32 by a return spring 33, such as a coiled spring, which is arranged between the free inner end of the tubular extension 29 and an opposite shoulder 34 formed on the anvil sleeve 28. A hose section 35 which is made from an elastic material sealingly engages with the outer surfaces of the anvil sleeve 28 and the tubular extension 29 on either side of the return spring 33. Pressurized liquid to be atomized may be supplied from a pressurized source or reservoir, not shown, to a transverse bore 36, which is defined in the valve seat member 17 and communicates with the axial bore receiving the valve member 21 therein. The transverse bore 36 is connected to the space receiving the return spring 33 through connecting bores 37.

An annular hammer member 38 encircling the stem part 22 is mounted on a diaphragm or membrane 39, the outer rim of which is clamped between the nozzle housing 16 and the screw cap 19. The hammer member 38, which is closely axially spaced from one end of the anvil sleeve 28 is axially movable between a position in which the diaphragm 39 is engaging with an O-ring 40 made from a resilient material, and a position in which the hammer member 38 is engaging with the adjacent end surface of the anvil sleeve 28. A solenoid 41 is arranged within the housing 16 coaxially with the valve member 21. When the solenoid is energized by connecting conductors 42 to an electric power source (not shown) the hammer member 38 as well as the valve member 21 are forcefully biased in the direction towards the anvil sleeve 28 by the magnetic forces induced by the solenoid. When the power supply to the solenoid 41 is cut off, the hammer member 38 is returned to its inactive position shown in FIG. 3 by the resilient diaphragm 39.

An annular end wall 43 is aligned with the solenoid 41 and positioned between the solenoid and the screw cap 19. The annular end wall 43 has a sharpened inner edge portion 44 which is radially aligned with the annular hammer member 38 so as to concentrate the lines of magnetic flux generated by the solenoid 41 at the hammer member.

While the valve member 21 is preferably made from metal, preferably stainless steel, the valve seat member 17 and the anvil sleeve 28 are preferably made from plastic material, such as delrin. However, the hammer member 38 and the housing 16 must be made from a magnetizable ferrous material.

The atomizing nozzle described above may be operated as follows:

When the nozzle is inoperative, the transverse bore 36, the connecting bores 37, and the annular space receiving the return spring 33 are filled with liquid to be atomized and are communicating with a source for liquid under pressure, for example through the supply conduit 14 shown in FIG. 2. The valve member 21 is kept in its closed, retracted position by the return spring 33 which means that the frustoconical surface part 24 is in sealing engagement with the valve seat 32. When the solenoid 41 is energized the magnetic field created causes the annular hammer member 38 to move suddenly to the right in FIG. 3 till the hammer member 38 strikes against the end surface of the anvil sleeve 28 which is fastened to the stem part 22. The impact load thereby transmitted to the anvil sleeve 28 together with the increasing magnetic force applied to the valve member 21 causes the valve member 21 to move to its open position at a high speed. The fully open position of the valve member 21 is determined by the abutting engagement between the concave and convex frustoconical abutment surfaces 30 and 31. The frustoconical shape of these surfaces tend to center the head 23 of the valve member 21 in relation to the annular valve seat 32. The opening speed of the valve member 21 is preferably such that almost no liquid is discharged through the annular nozzle opening until the valve member 21 is fully opened. In that moment a liquid film is ejected along the diverging frustoconical surface part 24, whereafter the liquid film almost "explodes" into small drops. The small part of the liquid may pass beyond the shall annular edge 27 and is then rejected from the conical surface part 25 of the head 23.

The valve member 21 is in its open position only for a very short period of time, for example about 125 $\mu$sec. This means that the solenoid 41 is energized only for a similar short period of time, and when the solenoid 41 is de-energized, the valve member 21 is returned to its closed position by the return spring 33, and thereafter the hammer member 38 is further returned to its starting position by the resiliency of the diaphragm 39. The return movement of the hammer member 38 and the diaphragm 39 is stopped by the O-ring 40 in order to reduce the rebound movement. Only when such rebound movement has stopped the next opening of the valve member may be initiated. The impact between the abutment surfaces 30 and 31 results in an intense rebound. The current pulse to the solenoid is preferably stopped just before the valve member 21 is in its fully open position. This means that such rebound tends to considerably accelerate the closing movement whereby it is possible to choose a relatively weak return spring 33.

It is understood that the time period for an opening and closing movement of the valve member 21 as well as the frequency of such opening and closing movements may to a great extent be controlled by controlling the current pulses supplied to the solenoid 41 from the power source. The operation of the nozzle is preferably controlled by a control circuit, which may, for example, be of the type shown in FIG. 5 and which may be arranged within the inhaler housing 11 or be an external unit.

FIG. 4 is a sectional view of part of a modified embodiment of the atomizing nozzle shown in FIG. 3. In the embodiment shown in FIG. 4, the valve seat member 17, which is disc-shaped, and which may be made from a plastic material, has been clamped between the nozzle housing 16 and an annular backing disc 45 preferably made from metal. An annular disc 46 made from piezo ceramics is positioned between the valve seat member 17 and the housing 16.

By means of the annular piezo ceramic member 46 ultrasonic vibrations may be imparted to the liquid immediately prior to being discharged through the nozzle opening. Therefore it is possible to further reduce the drop size of the atomized liquid. It is envisaged that the enlarged head 23 of the valve member 21 could also totally or partly be made from piezo ceramics so that ultrasonic vibrations could be imparted to the liquid film formed on the surface of the head 23 when liquid is being discharged from the nozzle. It is also possible to reduce the drop size by dissolving a gas, such as carbon dioxide, in the pressurized liquid to be atomized. Another possibility is to add suitable surface tension reducing means to the liquid.

FIG. 5 shows an example of a control circuit for controlling the operation of the atomizing nozzle 10. The control circuit comprises a programmable clock generator circuit 51 which allows the operating frequency of the nozzle to be chosen. Furthermore, in order to obtain a predetermined dose within a certain period of time, the circuit 51 can be programmed to generate the necessary number of clock cycles within that period of time, and a circuit 52 may be programmed to control the duty cycle, that is to control the opening and the closing period of the nozzle within one clock cycle. A circuit 53 ensures that full power is supplied to the connecting conductors 42 each time the valve member is to be moved from its closed to its open position, and that a minimum amount of power is consumed during operating of the nozzle. This means that all of a number of transistors used in the opening sequence of the nozzle are turned on at the same time, and when closing the nozzle, the transistors are all turned off at the same time and remains turned off until a new opening sequence. A circuit 54 delivers the supply voltage and operates together with circuit 53 to ensure that the full amount of voltage is supplied to the connecting conductors 42. In order to obtain a quick opening movement of the nozzle, it is important that the voltage supplied from the circuit 54 related to the self-indication in the solenoid in such a way that the current rises fast. A circuit 55 forms together with the solenoid 41 a tuned circuit with a Q approximately equal to one which is important in order to obtain a quick closing movement of the nozzle as this enables the energy in the solenoid 41 to be withdrawn very quickly.

FIG. 6 shows an atomizing nozzle for injecting liquid fuel into the air intake manifold or into the combustion chamber of a combustion engine in a finely atomized condition. In the embodiment shown in FIG. 6 parts corresponding to parts of the embodiment shown in FIG. 3 are designated the same reference numerals.

The housing 16 of the fuel atomizing device 56 comprises an outer tubular housing part 57, which is preferably made from metal, such as annealed steel. The housing 16 further comprises a spout part 58 and a valve seat member 17 arranged at one end of the housing part 57. The valve seat member 17 is made from metal such as stainless steel or copper. The opposite end of the housing part 57 is closed by a liquid inlet part 59 defining a liquid inlet 60, and the liquid inlet part and the adjacent end of the tubular housing part 57 are embedded in a mounting block 61. The inlet part 59 is preferably made from a non-magnetizable material, such as brass. A valve member 21 of the type shown in FIGS. 2 and 3 and comprising an enlarged head 23 and a stem part cooperate with a valve seat defined by the valve seat member. The valve member is preferably made from hardened stainless steel. The liquid inlet 60 and the valve member 21 are aligned and arranged at opposite ends of the atomizing device 56.

The stem part 22 of the valve member 21 is surrounded by and fastened to an anvil sleeve 28 by means of a thread connection and a nut 62. The anvil sleeve is preferably made from a non-magnetizable metal, such as an aluminum alloy. The stem part 22 extends through a guide member 63 which is arranged within the spout part 58 and between the valve seat member 17 and a tubular magnetic core 64 extending coaxially with the inlet 60 and the valve member 21. The magnetic core 64 is surrounded by a solenoid 41, which is sealed within an annular chamber defined between the outer housing part 57 and a tubular inner housing part 65. The magnetic core 64, which is made from a magnetizable material, such as annealed steel, has a number of peripherally spaced, longitudinally extending slits or slots 66, for example four equally peripherally spaced slots formed therein. Each slot extends radially from the outer surface of the core 64 to a position closely radially spaced from the inner bore of the tubular core. The slots 66 counteract the generation of eddy currents in the core when rapidly changing magnetic fields are generated by controlled current pulses supplied to the solenoid 41 from an electric power source, not shown, via an electrical connecting member 67.

An annular hammer member 38 of a magnetizable metal, such as annealed steel, is mounted on a diaphragm or membrane 39 having its outer rim portion clamped between the liquid inlet part 59 and an annular spacing member 68 which is positioned between the liquid inlet part and the adjacent end of the tubular inner housing part 65. One end of a thin-walled force transmitting tube preferably made from steel and having elongated openings 70 formed therein is received in the inner bore of the magnetic core 64 and is displaceably arranged therein. The force transmitting tube 69 extends between the hammer member 38 and a collar member 71 which is mounted on the outer surface of the anvil sleeve 28. The hammer member 38 is biassed towards a retracted position in the direction of the liquid inlet part 59 by a spring 72, such as a coil spring, acting between the hammer member 38 and the adjacent end of the magnetic core 64. Thus, in the retracted position of the hammer member 38 the opposite free end of the tube 69 is closely axially spaced from the collar member 71 and the diaphragm 39 engages with an O-ring 40 made from a resilient material forming a resilient abutment member. The hammer member 38 and the tube 69 fastened thereto are moveable between this retracted position and an advanced position in which the free end of the tube engages with the adjacent side surface of the collar member 71. The collar member 71 may be moved slightly axially in relation to the anvil sleeve 28 against the bias of a coil spring 73. As explained above in connection with the embodiment shown in FIG. 3, the valve member 21 is biassed towards its closed position by a return spring 33 surrounding the anvil sleeve 28 and in the open position of the valve the valve member 21 is kept in an exact central and axial position in relation to the valve seat 32 by the cooperating frustoconical abutment surfaces 30 and 31.

The atomizing nozzle device shown in FIG. 6 may be operated as follows:

Pressurized liquid, such as liquid fuel, is supplied through the liquid inlet 60 so that the spaces defined inside the inner surface of the tubular inner housing part 65, such as the inner bore of the magnetic core 64 and the outer slots formed therein, are filled with the liquid to be atomized and communicate with a pressurized fluid source, such as a high-pressure pump and a pressure control device, not shown. These liquid filled inner spaces are sealed by means of various sealing members, such as O-rings. These inner spaces are mutually interconnected and connected with the nozzle opening of the valve, i.a. via a number of through openings 74 formed in the hammer member 38, the elongated openings 70 in the wall of the force transmitting tube 69, one or more openings or bores 75 in the collar member 71, and openings or bores 76 which are formed in the guide member 63 and communicating with openings in an adjacent rotation generating disc member 77. This means that all moveable parts of the valve or nozzle device is arranged within liquid filled spaces, and because these spaces are interconnected by openings as mentioned above, movement of the various valve parts is not substantially hampered by the surrounding liquid.

In principle, the atomizing nozzle device shown in FIG. 6 operates similarly to that shown in FIG. 3 and as described above. Thus, when the solenoid 41 is de-energized the valve member 21 is kept in its closed retracted position by the return spring 33 and the hammer member 38 with the force transmitting tube 69 is biassed towards its retracted position by the spring 72. When the solenoid 41 is energized the magnetic field created causes the annular hammer member 38 with the tube 69 to move suddenly to the right in FIG. 6 against the bias of the spring 72. The advance movement of the hammer member 38 and the tube 69 is stopped when the hammer member hits an abutment ring 78 mounted between the spacing member 68 and the adjacent end of the inner housing part 65. The sudden axial movement of the force transmitting tube 69 is transmitted to the anvil sleeve 28 and to the valve member 21 via the collar member 71. Thus, the head of the valve member 21 may be moved from its fully closed to its fully opened position at a high speed. In case the anvil sleeve 28 should hit the guide member 63 before the hammer member 38 hits the abutment ring 78 due to an incorrect adjustment, the spring 73 may yield in order to prevent that excessive forces are transmitted to the valve parts adjacent to the nozzle openings.

When after a very short period of time the solenoid 41 is de-energized, the hammer member 38 is returned to its retracted position by the forceful spring 72 while the valve member 21 and the anvil sleeve 28 mounted thereon is returned to the closed position by the return spring 33. In the open position of the valve member 21 a rotary movement may be imparted to the liquid flowing to the nozzle opening by means of liquid channels formed in the down-stream side surface of the disc member 77. Otherwise, the atomizing nozzle device shown in FIG. 6 may operate substantially as described above with reference to FIG. 3.

The liquid fuel atomizing nozzle shown in FIG. 6 may be controlled by a control circuit of the type shown in FIG. 5 and as described above. Such control device may advantageously be adapted to operate the atomizing nozzle in at least two different modes. As an example, the atomizing nozzle may be operated in a starting mode in which very finely atomized droplets are generated, for example by using very short opening periods at higher frequencies for the vibrating valve member 21. Such starting mode may be used when atomized liquid fuel is supplied to a cold combustion engine to be started. When the engine has operated for some time and has become warm, the atomizing nozzle may be shifted to a second mode or a running mode using longer opening periods at lower vibration frequencies so that less finely atomized droplets are generated. However, such bigger droplets may easily evaporate when directed onto the inlet valve and injected into the warm combustion chamber of the engine.

EXAMPLE

Ethanol at a pressure of 300 Kpa was supplied to a nozzle as that shown in FIG. 3, and the movement of the valve member 21 with a frustoconical surface part 24 defining a top angle of 36° was controlled within a frequency range of 0–1000 Hz. The time period for moving the valve member 21 from its fully closed to its fully opened position was 60–70 μsec, and the time period for moving the valve member from its fully opened to its fully closed position was 60–95 μsec. The opening time of the valve member (defined as the time period between the moments where the valve member is halfway between its open and closed positions during the opening and closing movements, respectively) was 125 μsec. The stroke length of the valve member 21 was 60 μm, and the liquid volume discharged for each stroke was 0.11 μl. The drop size (volume distribution) was found to be 40–50 μm and mean diameter number distribution was found to be less than 3 μm depending on frequency. The drop size of the biggest drops was 140–170 μm also depending on frequency. Reproducibility of dosing was better than 1%.

It should be understood that various amendments and modifications of the embodiment shown above could be made within the scope of the present invention. As an example, the flexible hose section 35 may be replaced by a liquid-containing stiff housing, in which the hammer member 38 and the diaphragm 39 may be arranged. Furthermore, the atomizing nozzle could not only be used for inhalers and combustion engines, but also for any other purposes, where it is desirable to obtain an accurate dosing of liquid atomized into small drops. When the nozzle according to the invention is used for atomizing liquid fuel, such fuel could be injected in finely atomized, dosed amounts of fuel into the manifold or suction passages of combustion engines, or into a combustion chamber of any type.

We claim:

1. A method for atomizing a liquid into liquid drops by means of a valve device comprising a house defining an annular valve seat therein, a valve member having an annular surface part diverging in a direction downstream of the valve seat, the valve member being movable in relation to the housing between an open position in which an annular nozzle opening is defined between the annular, diverging surface part and the valve seat, and a closed position in which the diverging surface part is in sealing engagement with the valve seat, means for moving the valve member between its open and closed positions, and control means for controlling the movement of the valve member, said method comprising:

controlling the stroke of the valve member such that the minimum width of the annular nozzle opening defined between the diverging surface part of the valve member and the valve seat substantially exceeds the average value of the diameter of the liquid drops generated (measured by number distribution), when the valve member is in its open position; and supplying the liquid to be atomized to the nozzle opening at an elevated pressure.

2. A method according to claim 1, comprising the further step of controlling a stroke of the valve member so as to obtain a minimum width of the nozzle opening in the open position of the valve member of 3–20 times average value of drop diameter.

3. A method according to claim 2, wherein the minimum width of the nozzle opening is 5–10 times the average value of the drop diameter.

4. A method according to claim 1, wherein the valve seat is defined by a sharp annular edge.

5. A method according to claim 4, wherein the axial width of the annular valve seat is smaller than 0.2 mm.

6. A method according to claim 5, wherein the axial width of the annular valve seat is smaller than 0.1 mm.

7. A method according to claim 1, wherein the valve member further has a converging surface part extending downstream from the diverging surface part, an annular, sharp edge being defined between the diverging and converging surface parts.

8. A method according to claim 7, wherein the converging surface part defines a pointed end at the free downstream end of the valve member.

9. A method according to claim 7, wherein the diverging and converging surface parts are a frustoconical surface part and a conical surface part, respectively.

10. A method according to claim 7, wherein the annular edge defined between the diverging and converging surface parts has a diameter ranging from 0.3 mm to 1 mm greater than a diameter of the valve seat.

11. A method according to claim 1, wherein the diameter of the valve seat is 1–5 mm.

12. A method according to claim 11, wherein the diameter of the valve seat is 2.5–3 mm.

13. A method according to claim 1, wherein the diverging surface part is a frustoconical surface part defining an angle of 26°–50°.

14. A method according to claim 13, wherein the diverging surface part is a frustoconical surface part defining an angle of 32°–40°.

15. A method according to claim 7, wherein the converging surface part is a conical surface part defining an angle of 60°–120°.

16. A method according to claim 15, wherein the converging surface part is a conical surface part defining an angle of about 90°.

17. A method according to claim 1, comprising the further step of supplying the liquid to be atomized to the nozzle opening at a pressure of 300–700 kPa.

18. A method according to claim 1, comprising the further step of moving the valve member between the closed and open positions by electromagnetic means.

19. A method according to claim 18, comprising the further step of accelerating a first impact member by the electromagnetic means so as to apply an impact load to the valve member for obtaining a movement of the valve member from the closed position to the open position.

20. A method according to claim 19, comprising the further step of accelerating a second impact member by the electromagnetic means so as to apply an impact load to the valve member for obtaining a movement of the valve member from the open position to the closed position.

21. A method according to claim 18, comprising the further step of biasing the valve member towards the closed position by spring means.

22. A method according to claim 1, comprising the further step of moving the valve member from the closed position to the open position at an average speed exceeding 0.5 m/sec.

23. A method according to claim 1, wherein the valve seat and the diverging surface part of the valve member cooperating therewith are highly smooth, the Ra value being less than 0.4 $\mu$m.

24. A method according to claim 1, comprising the further step of maintaining a width of the annular nozzle opening to be uniform along a peripheral extension of the nozzle opening.

25. A method according to claim 1, wherein the valve member comprises an axial stem extending through the nozzle opening and into the housing.

26. A method according to claim 25, comprising the further step of defining the open position of the valve member by an abutment surface defined by the valve member stem for abutting engagement with a complementary surface defined in the valve housing, said abutment and complementary surfaces being shaped so as to secure alignment of the valve member in relation to the nozzle opening.

27. A method according to claim 1, comprising the further step of imparting a rotary movement to the liquid upstream of the valve seat around an axis of the valve seat and of the diverging annular surface part of the valve member.

28. A method according to claim 1, comprising the further step of controlling at least one of a frequency, a number of movements, opening period duration and closing duration of the valve member.

29. A method according to claim 28, comprising the further step of controlling a movement of the valve member from the closed position to the open position and back to the closed position so that the time period for the movement is less than ⅕ of a cycle of the valve member.

30. A method according to claim 29, wherein the time period for said movement is less than 1/10 of one cycle of the reciprocating movement of the valve member.

31. A method according to claim 28, comprising the further step of vibrating the valve member between the open and closed positions at a frequency of 10–2000 Hz.

32. A method according to claim 31, wherein the valve member is vibrated at a frequency of between 50–500 Hz.

33. A method according to claim 28, wherein the valve device is a fuel injection valve device, and comprising the further step of shifting from a starting mode in which small droplets are generated into a running mode in which larger droplets are produced.

34. A method according to claim 33, comprising the further steps of producing clouds of droplets in the starting mode, and directing jets of larger droplets onto an inlet valve of a combustion engine in which the fuel injection valve device is used in the running mode.

35. A valve device for atomizing a liquid into drops, said valve comprising a housing defining an annular valve seat therein by a sharp edge having an axial width smaller than 0.2 mm, a valve member having an annular surface part diverging in a direction downstream of the valve seat, the valve member being movable in relation to the housing between an open position in which an annular nozzle opening is defined between the annular, diverging surface part and the valve seat, and a closed position in which the diverging surface part is in sealing engagement with the valve seat, the valve member further defining a converging surface part extending downstream from the diverging surface part, an annular, sharp edge being defined between the diverging and converging surface parts, means for supplying pressurized liquid to be atomized to the nozzle opening, electromagnetic means for moving the valve member between its open and closed positions, control means for controlling the operation of the electromagnetic means so as to control the movement of the valve member.

36. A valve device according to claim 35, wherein the axial width of the annular valve seat is smaller than 0.1 mm.

37. A valve device according to claim 35, wherein the converging surface part defines a pointed end at a free downstream end of the valve member.

38. A valve device according to claim 37, wherein the converging surface part is a conical surface part defining an angle of 60°–120°.

39. A valve device according to claim 38, wherein the conical surface part defines an angle of about 90°.

40. A valve device according to claim 35, wherein the diverging and converging surface parts are a frustoconical surface part and a conical surface par, respectively.

41. A valve device according to claim 40, wherein the diameter of the annular edge defined between the diverging and converging surface parts is 0.3–1 mm.

42. A valve device according to claim 35, wherein the diameter of the valve seat is 1–5 mm.

43. A valve device according to claim 42, wherein the diameter of the valve seat is 2.5–3 mm.

44. A valve device according to claim 35, wherein the diverging surface part is a frustoconical surface part defining an angle of 26°–50°.

45. A valve device according to claim 44, wherein the frustoconical surface part defines an angle of 32°–40°.

46. A valve device according to claim 35 wherein the means for moving the valve member further comprises a first impact member, which may be accelerated by the electromagnetic means and which may apply an impact load to the valve member so as to obtain a quick movement of the valve member from its closed to its open position.

47. A valve device according to claim 46, wherein the valve member is biassed towards its closed position by spring means.

48. A valve device according to claim 35, wherein the valve seat and the diverging surface part of the valve member cooperating therewith are highly smooth, the Ra value being less than 0.4 $\mu$m.

49. A valve device according to claim 35, wherein the valve member comprises an axial stem extending through the nozzle opening and into the housing, the valve member stem defining an abutment surface thereon for abutting engagement with a complementary surface defined in the valve housing, so as to determine the open position of the valve member, said surfaces being shaped so as to secure alignment of the valve member in relation to the nozzle opening.

50. A valve device according to claim 35, further comprising means arranged upstream of the valve seat for imparting to the liquid passing the valve seat a rotary movement around an axis of the valve seat and of the diverging annular surface part of the valve member.

51. A valve device according to claim 35, wherein the valve seat is made from a material selected from the group consisting of stainless steel and copper.

52. A method for atomizing a liquid into liquid drops by a valve device comprising a housing defining an annular valve seat therein, a valve member having an annular surface part diverging in a direction downstream of the valve seat, the valve member being movable in relation to the housing between an open position in which an annular nozzle opening is defined between the annular, diverging surface part and the valve seat, and a closed position in which the diverging surface part is in sealing engagement with the valve seat, means for moving the valve member between its open and closed positions, and control means for controlling the movement of the valve member, said method comprising:

controlling a stroke of the valve member so that a minimum width of the annular nozzle opening substantially exceeds the average value of the diameter of the liquid drops generated, when the valve member is in its open position, supplying the liquid to be atomized to the nozzle opening at an elevated pressure, and accelerating a first impact member by electromagnetic means so as to apply an impact load to the valve member for obtaining a quick movement of the valve member from the closed to the open position.

53. A method according to claim 52, comprising the further step of biasing the valve member towards the closed position by spring means.

54. A method according to claim 52, comprising the further step of accelerating a second impact member by the electromagnetic means so as to apply an impact load to the valve member for obtaining a quick movement of the valve member from its open to its closed position.

55. A method according to claim 52, comprising the further step of moving the valve member from the closed to the open position at an average speed exceeding 0.5 m/sec.

56. A method according to claim 52, wherein the valve member comprises an axial stem extending through the nozzle opening and into the housing, and comprising the further step of determining the open position of the valve member by an abutment surface defined by the valve member stem for abutting engagement with a complementary surface defined in the valve housing, said abutment and complementary surfaces being shaped so as to secure alignment of the valve member in relation to the nozzle opening.

57. A method according to claim 52, comprising the further step of imparting a rotary movement to the liquid upstream of the valve seat around an axis of the valve seat and of the diverging annular surface part of the valve member.

58. A method according to claim 52, comprising the further step of controlling at least one of a frequency, a number of movements, an opening period duration, and a closing period duration of the valve member so as to control an average size of the liquid drops.

59. A method according to claim 58, comprising the further step of controlling a movement of the valve member from the closed to the open position and return to the closed position so that the time period for the movement is less than ⅕ of one cycle of the reciprocating movement of the valve member.

60. A method according to claim 52, wherein the valve device is a fuel injection valve device, and comprising the further step of shifting from a starting mode in which relatively small droplets are generated into a running mode in which larger droplets are produced.

61. A method according to claim 60, comprising the further step of producing clouds of droplets in the starting mode, and directing jets of larger droplets onto an inlet valve of a combustion engine in the running mode in which the fuel injection valve device is used in the running mode.

62. A valve device for atomizing a liquid into liquid drops, said valve comprising a housing defining an annular valve seat therein being defined by a sharp edge, a valve member having an annular surface part diverging in a direction downstream of the valve seat, the valve member being movable in relation to the housing between an open position in which an annular nozzle opening is defined between the annular, diverging surface part and the valve seat, and a closed position in which the diverging surface part is in sealing engagement with the valve seat, means for supplying pressurized liquid to be atomized to the nozzle opening, means for moving the valve member between its open and closed positions, including electromagnetic means for accelerating a first impact member, to apply an impact load to the valve member so as to obtain a quick movement of the valve member from its closed to its open position, and control means for controlling the movement of the valve member.

63. A valve device according to claim 62, wherein the annular valve seat has an axial width less than 0.2 mm.

64. A valve device according to claim 62, wherein the valve member further has a converging surface part extending downstream from the diverging surface part, an annular, sharp edge being defined between the diverging and converging surface parts.

65. A valve device according to claim 64, wherein the converging surface part has a pointed end at a free downstream end of the valve member.

66. A valve device according to claim 65, wherein the diverging and converging surface parts are a frustoconical surface part and a conical surface part, respectively.

67. A valve device according to claim 66, wherein the frustoconical surface part defines an angle ranging from 25° to 50°.

68. A valve device according to claim 66, wherein the conical surface part defines an angle ranging from 60° to 120°.

69. A valve device according to claim 62, wherein the valve member is biassed towards the closed position by spring means.

70. A valve device according to claim 69, wherein the valve member comprises an axial stem extending through the nozzle opening and into the housing, the valve member stem defining an abutment surface thereon for abutting engagement with a complementary surface defined in the valve housing, so as to determine the open position of the valve member, said surfaces being shaped so as to secure alignment of the valve member in relation to the nozzle opening.

71. A valve device according to claim 69, where in the valve seat is made from a material selected from the group consisting of stainless steel and copper.

* * * * *